United States Patent [19]

Stratton et al.

[11] 4,251,265

[45] Feb. 17, 1981

[54] CLAY PREPARATION

[75] Inventors: Claud L. Stratton; James F. Kane, both of Benton, Ark.

[73] Assignee: Reynolds Metals Company, Richmond, Va.

[21] Appl. No.: 61,300

[22] Filed: Jul. 27, 1979

[51] Int. Cl.[3] ..... C22B 1/24

[52] U.S. Cl. ..... 75/3; 75/5

[58] Field of Search ..... 75/3, 4, 5

[56] References Cited

U.S. PATENT DOCUMENTS

| | | | |
|---|---|---|---|
| 3,192,290 | 6/1965 | Polon | 23/313 X |
| 3,240,562 | 3/1966 | Brown et al. | 423/132 X |
| 3,864,118 | 2/1975 | Schumacher et al. | 75/3 |

*Primary Examiner*—G. Ozaki

*Attorney, Agent, or Firm*—Glenn, Lyne, Girard & McDonald

[57] ABSTRACT

There is described a novel process for pelletizing clay containing aluminumous ore comprising the steps of:

a. crushing the clay to within an appropriate size range;

b. blending the crushed clay with water to achieve a closely defined moisture content;

c. pelletizing the clay in a suitable apparatus to provide clay pellets of predetermined size;

d. rolling the pellets for a period of time sufficient to round the edges, corners, etc. and to produce a relatively hard, abrasive resistant surface; and e. drying and calcining the pellets at a temperature within the range of from about 1100° to about 1500° F.

4 Claims, 2 Drawing Figures

SERIAL NO. 061300
GROUP ART UNIT 111

CLAY PREPARATION

FIELD OF THE INVENTION

The present invention relates to a method for preparing various ore containing clays for processing and extraction of the ore values and more particularly to a method for pelletizing aluminous ore containing clays for acid or other extraction of the aluminous values therefrom.

BACKGROUND OF THE INVENTION

With the decline in the availability of high aluminum content ores throughout the world and a desire to make use of lower assay domestic clays numerous processes have been suggested and developed for the extraction of aluminum values from such "low" assay clays. Of particular interest in recent years have been the so-called "acid" extraction techniques. According to these techniques, the clay is treated with an acid, usually nitric, hydrochloric or sulfuric, to extract the aluminum values which are subsequently purified and refined according to a variety of conventional or novel methods.

In any such extraction process the first step is to place the clay in a condition such that it can be treated with an appropriate acid to yield the aluminum values while leaving the clay behind. Numerous clay preparation methods have been described and are generally well known to those skilled in this art.

With the evolution of the fluidized or expanded bed and the development of extraction techniques using this operation, the clay preparation step becomes even more crucial to the development of successful commercial clay extraction techniques.

Most alumina digestion operations described in the literature comprise the co-current digestion, over a substantial period of time, of powdered or coarse-ground calcined kaolin at atmospheric or superatmospheric pressure, followed by a large number of stages of counter-current decantation washing of the solids separated from the product liquor. Even when using coarsely-ground calcined clay from which fines have been separated before leaching, the requirements for maintaining the co-currently digesting slurry in a mixed condition, and for obtaining good mixing between the settled solids and wash liquors in the countercurrent decantation washing stages, are impossible to fulfill without the generation of excessive quantities of very fine silicious slimes of around 10 micron and down particles. The slimes settle very slowly, and only to relatively dilute slurries. Large amounts of water, that must be subsequently evaporated, and many washing stages are required to obtain washed slimes which still may contain excessive quantities of acids. However, production by the process herein described of size-tailored pellets, with all the initially-induced edges, corners and protruding areas rounded off toward the spherical shape, permits practice of counter-current digestion and washing methods that avoid the aforesaid washing difficulties and which also can provide a product liquor containing dissolved alumina in excess of stoichiometric requirements. Such pelletizing when using nitric acid leaching permits use of an essentially zero-energy-requirement process for the removal of iron and silica values to levels sufficiently low that the final specifications with regard to these elements can be obtained in a crystallization process.

Many methods, mostly expensive, are well known in the art for preparing pellets of kaolin clay which can then be calcined to provide feed for digestion. We have used in the early stages of our investigations cylindrical extrusions produced by forcing properly-moistened clay through sized holes in a die, and round balls produced by agglomeration of dried, ground clay with water on a pelletizing disk.

SUMMARY OF THE INVENTION

Figure 1:
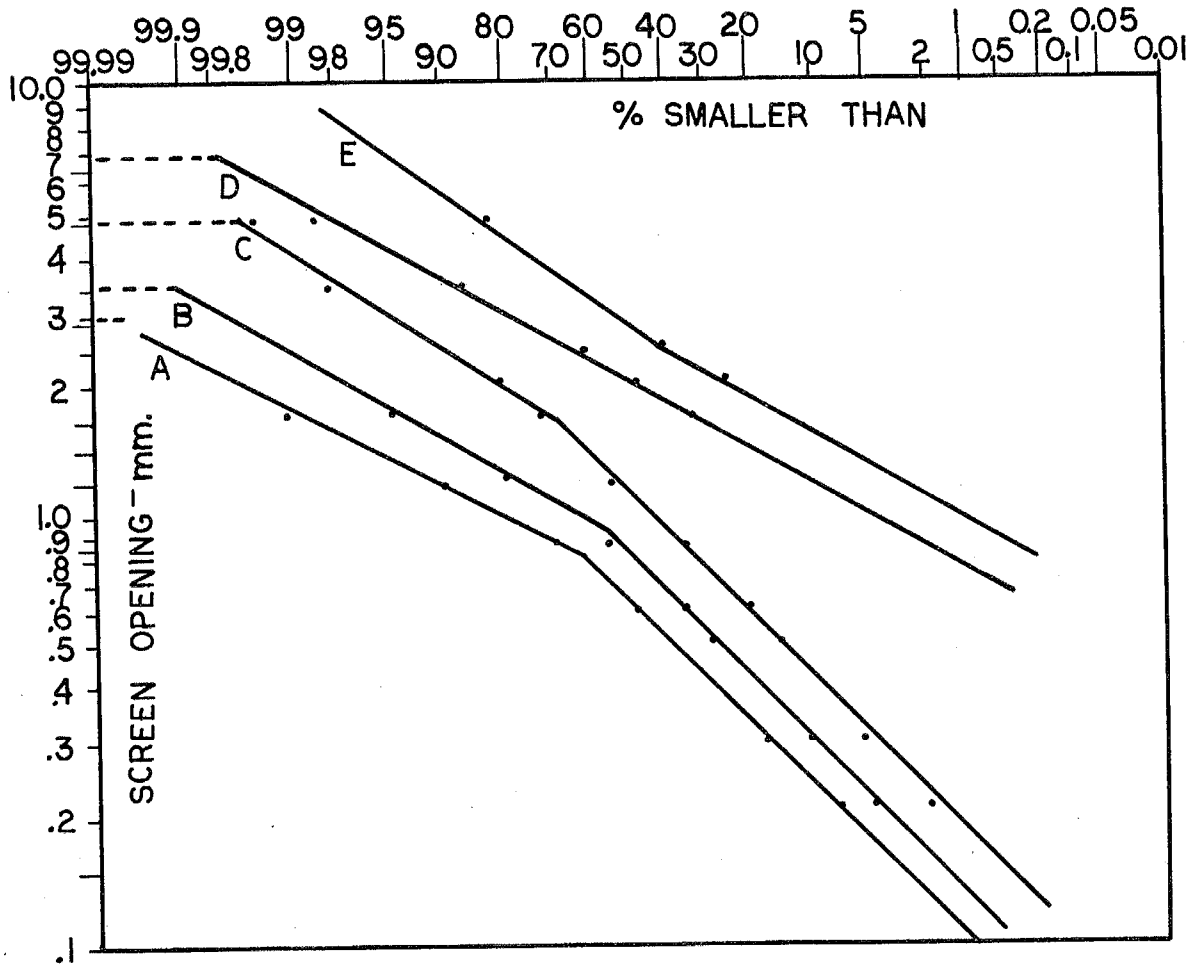
FIGS. 1 and 2 are graphs showing particle size distribution of product pellets formed under a variety of screen sizes and moisture contents according to the practice of the instant invention.

The present invention provides a novel clay preparation technique which provides pelletized clay admirably suited for extraction of aluminum values by countercurrent acid extraction.

In the clay preparation process of the present invention as mined clay is crushed to within an appropriate size range, blended with water to a closely defined moisture content, and passed through a hammer-mill or other suitable equipment of appropriate design to provide clay pellets of a specified screen size. The resulting sized pellets are then rolled, substantially without agglomeration, for a period of time sufficient to round the edges, corners, etc. and produce a relatively hard, abrasion resistant surface, i.e. the pellets are "surface hardened" by rolling. The rolled pellets are then dried by appropriate means and calcined at a temperature within the range of from about 1100° to about 1500° F., preferably in a fluidized bed heated by in-bed combustion of a suitable fuel.

DETAILED DESCRIPTION

According to the present invention, as-mined clay crushed to a suitable maximum size by known means is blended with what additional water may be required, in, for instance, a mix muller, to obtain an intimate mixture of moisture and clay of a defined moisture content and is then passed through a suitable apparatus, for example, a hammer-mill comprising rotating knives on a vertical shaft surrounded by a 360° screen of specified aperture preferably between about 2 and about 8 mm, to produce a relatively narrow size range of damp particles. A preferred size range for the pellets is between about 1 and about 8 mm. Such particles or pellets are subsequently rolled in a drum, while taking due care to prevent agglomeration, for a relatively short period to press all jagged edges and the like into a relatively firm surface which tends toward a spherical shape and which is relatively resistant to abrasion, i.e. the pellets are "surface hardened". At the proper moisture content the particle size range of the product is controlled by the selection of the size of openings in the 360° product discharge screen of the hammermill or other suitable apparatus. The free moisture content, i.e., other than water of hydration, is critical to the operation and must be held within somewhat narrow limits which vary somewhat with the composition of the kaolin material. Thus a sand-free kaolin material, but with variable iron oxide impurity content, requires a moisture content between about 19 and 21% but produces a more desirable size distribution at levels between 19 and 20%. At moisture levels of about 22% this material will blind the screens and pile up on the hammers and shaft requiring the mill to be shut down and cleaned out. At 18% moisture the product is essentially fine material unsuitable for the intended usage. Silica sand, which is frequently present in the kaolin bed, decreases the water requirement but does not prevent processing to suitable pellets at the proper moisture content. Thus a material which assays 21% silica and on a dry solids basis causes screen blinding at moisture contents of 18½% and above, but is processable at 18% moisture. The optimum moisture content is judged to be between about 17.5 and 18%.

On the other hand the introduction of calcined fine material, such as might be recovered from the off gases of a fluid bed calciner, increases the moisture content requirement, pesumably because some water is absorbed into the pores of the calcined material. One such material, comprising 80 parts (dry weight basis) clay and 20 parts recycled calcined material, produced satisfactory pellets at a moisture level of 22%. Pellets formed by the tornado mill-screen combination described hereinabove are rolled to flatten out angular projections, corners and the like to minimize undesirable attrition in the fluid bed calciner and during digestion and handling of the fired pellets. A simple but efficient means for accomplishing this is a device, known to the art as a rolling drum, which consists essentially of a large diameter, long pipe or tube which may, if desired, contain one or more lifter means. As the drum or pipe is rotated pellets are fed at a feed end and pass slowly down the slightly inclined tube for a period of time which can be defined by the length of the tube and the inclination of the tube to the horizontal. In the passage, the pellets impinge upon each other and roll along the sides of the tube with the concurrent impartation of energy to the surfaces of the pellets whereby protruding areas are pushed inwardly to the pellet body, the surfaces are smoothed and rounded, and the pellet is gradually massaged toward a spherical shape. It is also known to generate pellets by agglomeration in such devices, however in the instant case the desired pellet masses have already been generated so that it is necessary to minimize further agglomeration to prevent growth of the particles into undesirably large sizes. The rolling drum could of course be used to produce pellets in the first place, however, we have found that the maximum pellet size and the pellet size distribution is exceedingly difficult to control in a manner to produce, per pass, an economical proportion of pellets within the size ranges desired for the digestion operation.

The pellet should be subjected to the rolling action of the drum for periods upwards of at least 5 minutes but we have found that by 30 minutes rolling the pellets are sufficiently compacted that further improvement is slow. As the pellets are rounded and surface-hardened by the peening action of the bed of pellets and of the metal shell, water is forced to the surface of the pellet, increasing their stickiness and thereby facilitating agglomeration of the particles into undesirably large masses.

The time required in the rolling drum to develop an undesirable sticky surface varies somewhat inversely with the moisture content of the materials entering the rolling drum. Thus pellets made with 21% moisture will begin to develop undesirable agglomeration tendencies within about 5 or 10 minutes.

Pellets produced at 19% moisture have been rolled successfully for 15 to 20 minutes while pellets which are dried to 18½% moisture before introduction into the rolling drum have been rolled for 30 minutes or more (up to 60 minutes). By the use of a standardized attrition test, which comprised digesting a small amount of the calcined clay pellets with nitric acid in a cylindrical bomb while rotating the bomb at a constant rate and at the conclusion of the digestion period measuring the concentration of attrited solids suspended in the liquor decanted from the bomb, it was found that low attrition rates were favored by longer rolling times at moisture contents of 18½% or higher, with the lowest attrition rates being obtained for pellets predried to 18½% moisture and rolled for 30 minutes. We have found however that the same benefits can be obtained without the need of the separate drying step if the pellets are rolled in the presence of a draft of relatively dry air, whereby at least a portion of the aforesaid generated surface moisture is removed as it is formed under conditions which do not bring about substantial drying of the interior of the pellet. Little or no heating of the air is required because in a continuous flow process the pellets enter the rolling drum already warm, i.e., above ambient temperature, from the conversion into heat of the energy imparted to the material during mulling and milling.

Calcination of the pellets for the aforesaid standardized attrition tests were carried out at 1350° F. in the laboratory furnace with the production of low attrition rates and high solubility of the contained alumina. Similar tests using product calcined at higher temperatures gave lower attrition rates while preserving the same solubility of the contained alumina at calcination temperatures up to 1550° F. It is of course well known in the art that 1550° F. is about the maximum calcination temperature that can be employed without reducing the solubility of the contained alumina. Since, as is well known, the alumina solubility is excellent for calcination temperatures between about 1100° and 1550° F., the practitioner has available a wide temperature range for calcination. However, the range is restricted considerably by the choice of fuel and the choice of the calcination equipment. Thus when using methane, temperatures must exceed about 1400° F. for proper combustion. Only a little lower temperatures can be used with fuel oil or with coal. Rotary calciners are somewhat difficult to control sufficiently to operate at temperatures, for instance, high enough to utilize natural gas while at the same time preventing over-burning of at least a portion of the material. This difficulty is surmounted with use of a fluid bed calcining means which, as is well known in the art, can be controlled easily to within a range of 15° to 30° F. of a specified temperature so that even a 1500° F. bed temperature may be used without danger of creating hot spots in the bed.

Thus by the aforesaid relatively inexpensive method of preparing substantially rounded pellets within a size range eminently satisfactory for use in fluid beds, and in themselves relatively resistant to attrition, we are able to calcine the said pellets within the temperature range of about 1500° to 1550° F. without danger of overburning any of the material, and at the same time obtain the benefits of the lower attrition rates so provided.

EXAMPLE 1

Figure 2:
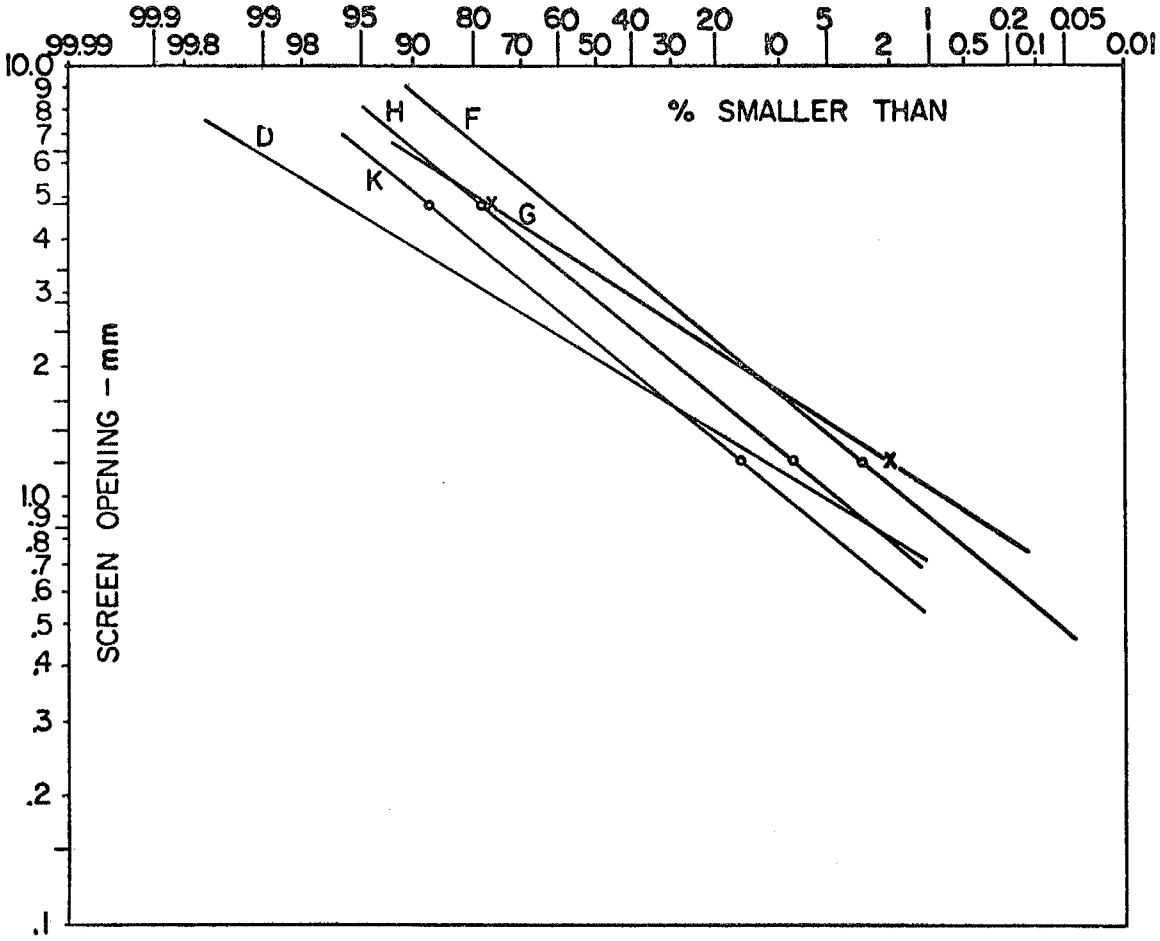

The following practices, for which particle size distribution data are presented in FIGS. 1 and 2, indicate generally the effect of screen size and moisture content on product size distribution. materials for these tests were mulled in a laboratory-size mix-muller of standard design. The blended damp material then was passed through a 10½" diameter tornado mill, Model 44-0, manufactured by the Stokes Machine Company, using various screen sizes as indicated, and the resulting pellets were rolled in a 55 gallon drum in which two 1½" wide by ¼ thick steel plates had been welded lengthwise to the side of the drum to serve as lifters.

Referring to FIG. 1, the size distributions of the product from the use of each of the 5 different size screens on the tornado mill are shown in curves A, B, C, D and E. Curve D, which was made with a 3 mesh screen with square openings of about 6.7 mm formed by 1.87 mm wire and with 20% moisture content in the clay, shows a particularly desirable size distribution. This was the average size distribution while processing of material containing 550 pounds of dry solids through the tornado mill and then rolling for 15 minutes. This material contained only a minor amount of +6 mm material, and only 5% of minus 1 mm material from which a satisfactory portion could be removed easily by passing over a 16 or 18 mesh screen. Curves A, B, C and E were obtained with 0.8 mm, 3.35 mm, 4.75 mm and 12.7 mm square-opening screens respectively, with about 21% moisture in the clay feed.

A Product D which was ground at about the optimum moisture content of 20% gives a substantially straight line distribution whereas products A, B, and C ground at about 21% moisture, departed from the straight line relation in the direction of the formation of excessive amounts of very fine particles. It is thought that Product E, which was also ground at 21% moisture, indicates a beneficial affect of reducing the rotation rate of the knives in the tornado mill from a normal 3500 rpm to 2200 rpm. The increased production of fines with damper material is indicated also in curves F and G of FIG. 2 in which curve F was ground at 21% moisture through a half inch U.S. Sieve series screen and Curve G, which exhibits a lower proportion of fines, was ground through the same screen at 19% moisture. Curve G is substantially parallel to Curve D. Products H and K indicate the influence of some diluents, Product H comprising 20% (dry weight basis) of calcined and ground clay and ground at 22% moisture, and Product K comprising a mixture of sandy clay and nonsandy clay blended to provide 21% sand (dry basis) and ground at 18% moisture. From the slopes of the curves compared to Curves D and G it is thought that both of these products contained slightly more water than the optimum.

It is of course preferred to control moisture content to a specific value as determined by any number of well known methods of determination including drying the material at 105° C. In addition, however, we have found that several observations and/or tests readily performed by the operator can be used as guides for adjusting the moisture content as, for instance, the quantity of sand in the clay being fed might change from time to time. As aforesaid, the slopes of the product pellet size distribution presented in FIGS. 1 and 2, which are readily determinable by well known methods of screening, are useful for indicating when the moisture content is about right or it might be lowered slightly to improve product size distribution. We have also noticed that, when the moisture content is about right, small balls of a quarter inch or so diameter tend to form in the muller during the mulling operation. This action can serve as a quick visual check on the adequacy of the moisture content. As the moisture content increases beyond desirable levels, the lumps become larger and appear wetter and eventually will become quite pasty. Conversely, as the moisture content decreases below the desirable level, the balls become smaller, tending toward grains, and mulled material compressed in the hand into lumps will tend to fall apart when the hand pressure is released.

We have found these visual observations to be quite useful during production runs as a check on the performance of the flow control instruments and on the constancy of the moisture, sand content, etc. of the bulk clay being fed to the muller.

EXAMPLE 2

Various raw clays were mulled and passed through the tornado mill of Example 1 with 360° screen aperture size and feed moisture content as shown in the following table. For most tests a large screen aperture size and a higher than optimum clay feed moisture content were used to permit obtaining high moisture contents for the rolling tests. Tornado mill products were rolled in the aforedescribed rolling drum at 21 rpm and at the moisture contents and for the times shown. To obtain a lower moisture content in the feed to the rolling drum than that of the mill product the mill product was partially dried in a steam-heated oven at about 110°–120° C. Rolling times at the higher moisture contents were limited by the extrusion of water from the pellet interior and the consequent development of sticky surfaces and severe agglomeration tendencies. Samples of the feed to and product of the rolling were dried and hand screened to determine the amount of pellets within the size range of about 4.8 to 1 mm dia.

The rolling drum products were dried in the steam-heated dryer and then were calcined in a static-bed oven at about the calcination temperatures shown. The calcined product was hand screened to obtain the about 4.8 to 1 mm size range fraction for attrition testing.

The attrition test equipment consisted essentially of a 1-liter cylindrical titanium bomb of about 10.7 cm i.d. by 14.9 cm long, suspended axially in a harness rotatable axially at a constant speed of 13 rpm by an externally-attached motor and gear means, within an oven controlled at a constant temperature of 250° F. by a temperature control means.

TABLE

EXAMPLE 2

| RUN NO. | 17 | 11 | 12 | 13 | 14 | 16 | 24 | 18 | 30 | 31 | 25 | 26 | 19 | 21 | 22 |
|---|---|---|---|---|---|---|---|---|---|---|---|---|---|---|---|
| CLAY SAMPLE | 71–132 | 71–132 | 71–132 | 71–132 | 71–132 | 71–132 | 71–132 | 74–249 | 71–132 | 75–5 | 75–5 | 75–5 | 71–132 | 71–132 | 71–132 |
| ADDITIVE | | | | | | 20% Calcine | 24% Sand | | Lump Clay Fired, Crushed, and Screened | Not Rolled | | | | | |
| Rolling Moisture, % | 21 | 18.5 | 20 | 20 | 18.1 | 22 | 18 | 22 | | | 20 | 20 | 21 | 21 | 18.5 |
| Rolling Time, Minutes | 5 | 30 | 30 | 30 | 30 | 8 | 15 | 5 | | 0 | 15 | 15 | 5 | 5 | 30 |
| % −4.8 + 1 mm Size Range | | | | | | | | | | | | | | | |
| Before rolling | 70 | 64 | 64 | 46 | 25 | 62 | 61 | 71 | | 78 | 78 | 61 | 70 | 70 | 64 |
| After rolling | 73 | 65 | 74 | 49 | 24 | 72 | 72 | 69 | | — | 84 | 88 | 73 | 73 | 65 |

TABLE-continued

| | EXAMPLE 2 | | | | | | | | | | | | | | |
|---|---|---|---|---|---|---|---|---|---|---|---|---|---|---|---|
| RUN NO. | 17 | 11 | 12 | 13 | 14 | 16 | 24 | 18 | 30 | 31 | 25 | 26 | 19 | 21 | 22 |
| Firing Temp. - °F. | 1350 | 1350 | 1350 | 1350 | 1350 | 1350 | 1350 | 1350 | 1350 | 1350 | 1350 | 1550 | 1600 | 1500 | 1550 |
| Attrited Solids | | | | | | | | | | | | | | | |
| % in liq. | 1.34 | 0.54 | 1.19 | 1.01 | 2.24 | 1.55 | 1.84 | 1.28 | 2.54 | 2.04 | 1.21 | 1.16 | 0.79 | 0.99 | 0.18 |
| % of pellet charge | 4.8 | 1.9 | 4.3 | 3.6 | 8.1 | 5.6 | 6.6 | 4.6 | 9.1 | 7.3 | 4.4 | 4.2 | 2.8 | 3.6 | 0.6 |
| Particle Preparation | | | | | | | | | | | | | | | |
| % Moisture | 21 | 21 | 21.5 | 20 | 18.1 | 22 | 18 | 22 | — | 20.0 | 20.0 | 20.0 | 21 | 21 | 21 |
| Screen Aperture, mm | 12.7 | 12.7 | 12.7 | 12.7 | 12.7 | 12.7 | 12.7 | 12.7 | | 6.7 | 6.7 | 6.7 | 12.7 | 12.7 | 12.7 |
| % $Fe_2O_3$ - Raw Clay | 4.7 | | | | | | | 13.5 | | 10.5 | | | | | |

The bomb was charged with 150 grams of the 4.8 on 1 mm size range pellets and 520 grams of a 40% nitric acid-in-water solution, closed, placed in the harness within the already-hot-oven, and rotated at 13 rpm for 240 minutes. The bomb was then removed from the oven and cooled and the residual pellets were separated from the slurry by pouring the slurry through a screen with about 1 mm square apertures. Solids passing through the screen with the liquor were separated from the liquor, washed with water, dried and weighed.

This attrition test is believed to provide more strenuous attriting conditions than would be obtained during fluid-bed calcination of the pellets or in counter-current extraction of the pellets by passage of digestion liquor through fixed, expanded, or partially-or-totally-fluidized beds of pellets.

EXAMPLE 3

A 4-inch diameter by 2½ inch deep bed of about −4.8+1 mm undried and unfired pellets, comprising 19.68% free moisture, and produced as in test 26, of Example 2, was subjected to a series of compression forces up to 7 psi acting through a 4-inch diameter vertical piston in accordance with appropriate weights gently placed upon the top of the piston. A thirty-minute settling period after imposition of each pressure increment was allowed before measuring the bed compression. The loose bed compacted about 24% but the pellets did not agglomerate and showed very little change in surface appearance or overall shape. A gentle rolling action in the palm of the hand was sufficient to separate the individual pellets from each other.

From the foregoing, it is apparent that the clay granulation technique described herein provides particulte clay optimally suited to extraction in fluid or expanded bed techniques.

What is claimed is:

1. A process for pelletizing clay containing aluminous ore comprising the steps of:

a. crushing the clay to within an appropriate size range;

b. blending the crushed clay with water to achieve a moisture content of between about 17.5 and about 22 percent by weight water;

c. pelletizing the clay in a suitable apparatus to provide clay pellets of predetermined size;

d. surface hardening the pellets; and e. drying and calcining the pellets at a temperature within the range of from about 1100° to about 1500° F.

2. The method of claim 1 wherein the pelletizing is performed using a hammermill comprising rotating knives on a vertical shaft surrounded by a 360° screen having an aperture size of between about 2 and about 8 mm.

3. The method of claim 1 wherein said surface hardening is accomplished by rolling the pellets in a rolling drum.

4. The process of claim 3 wherein the rolling is performed for a period of between about 5 and about 60 minutes.

* * * * *